US009496650B1

(12) United States Patent
Lan

(10) Patent No.: US 9,496,650 B1
(45) Date of Patent: Nov. 15, 2016

(54) CONNECTOR MODULE

(71) Applicant: Wistron Corporation, New Taipei (TW)

(72) Inventor: Chang-Feng Lan, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/931,867

(22) Filed: Nov. 4, 2015

(30) Foreign Application Priority Data

Jul. 22, 2015 (TW) ..... 104123649 A

(51) Int. Cl.
*H01R 13/62* (2006.01)
*H01R 13/642* (2006.01)
*H01R 13/635* (2006.01)

(52) U.S. Cl.
CPC ..... *H01R 13/642* (2013.01); *H01R 13/635* (2013.01)

(58) Field of Classification Search
CPC H01R 13/642; H01R 13/635; H01R 13/633; H01R 23/7005; H01R 23/70
USPC ..... 439/152–160, 217
See application file for complete search history.

(56) References Cited

U.S. PATENT DOCUMENTS 7,865,210 B2 * 1/2011 Wang ..... H04M 1/026 439/153
9,232,668 B2 * 1/2016 Sloey ..... H04B 1/3816
9,389,639 B2 * 7/2016 Yoon ..... H04M 1/236
2014/0377986 A1 12/2014 Endo et al.

FOREIGN PATENT DOCUMENTS

TW M354922 4/2009
TW 201340489 10/2013
TW M478894 5/2014

* cited by examiner

*Primary Examiner* — Khiem Nguyen
(74) *Attorney, Agent, or Firm* — Jianq Chyun IP Office

(57) ABSTRACT

A connector module adapted to be connected to a connection interface is provided. The connector module includes a main body, a connection component and at least one protrusion component. The connection component is disposed at the main body. The protrusion component is disposed at the main body. The protrusion component is adapted to receive an external force to move along a first direction, so as to change relative positions of the connection component and the protrusion component such that the connection component is adapted to be plugged into the connection interface along a second direction. The first direction is opposite to the second direction.

19 Claims, 7 Drawing Sheets

CONNECTOR MODULE

CROSS-REFERENCE TO RELATED APPLICATION

This application claims the priority benefit of Taiwan application serial no. 104123649, filed on Jul. 22, 2015. The entirety of the above-mentioned patent application is hereby incorporated by reference herein and made a part of this specification.

BACKGROUND OF THE INVENTION

1. Field of the Invention

The invention generally relates to an electronic module, more particularly, to a connector module.

2. Description of Related Art

With the development of electronic technology, connectors are broadly applied in various electronic devices and their corresponding connecting lines, such as notebook computers, Tablet PCs, Smart Phones and their transmission lines. By plug connecting two connectors with each other, signals may be transmitted between the electronic devices.

A connecting portion (e.g., a connection terminal) of the connector is generally designed to be exposed, and thus when the connector is not plugged, the connecting portion thereof is liable to deformation due to being subjected abrasion or damaged by an external force. In addition, when the connecting portion is plugged into a corresponding connection interface, the connecting portion may also be deformed and damaged when subjecting to excessive insertion force due to tolerance in manufacturing and assembling. The aforesaid conditions may both cause the connecting portion to result in poor electrical connection and become unable to perform power and signal transmissions normally. Therefore, how to effectively protect the connecting portion of the connector without influencing its convenience in use is an important issue for those skilled in the field.

SUMMARY OF THE INVENTION

The invention is directed to a connector module, which is capable of preventing a connecting portion thereof from being subjected to abrasion or damaged by an external force, and can conveniently be plugged into a corresponding connection interface.

The connector module of the invention is adapted to be connected to connection interface. The connector module includes a main body, a connection component and at least one protrusion component. The connection component is disposed at the main body. The protrusion component is disposed at the main body. The protrusion component is adapted to receive an external force to move along the first direction, so as to change relative positions of the connection component and the protrusion component, so that the connection component is adapted to be plugged into the connection interface along a second direction. The first direction is opposite to the second direction.

In an embodiment of the invention, the connection interface is adapted to push the protrusion component along the first direction so as to provide the external force.

In an embodiment of the invention, the protrusion component is adapted to move from a first position to a second position along the first direction, a length of the protrusion component protruding from the main body when the protrusion component is at the first position is not less than a length of the connection component protruding from the main body, a length of the protrusion component protruding from the main body when the protrusion component is at the second position is less than a length of the connection component protruding from the main body.

In an embodiment of the invention, the protrusion component is slidingly disposed at the main body along the first direction, and the connection component is slidingly disposed at the main body along the second direction.

In an embodiment of the invention, the connector module includes a first elastic component, wherein the first elastic component is connected between the protrusion component and the main body, and after the protrusion component moves along the first direction, the protrusion component is adapted to be restored along the second direction via an elastic force of the first elastic component.

In an embodiment of the invention, the connector module is adapted to be installed at an electronic device, the protrusion component protrudes out of the electronic device, the connection component is located within the electronic device, the protrusion component is adapted to move along the first direction to drive the connection component to protrude out of the electronic device along the second direction.

In an embodiment of the invention, the connector module includes a driven component, wherein the driven component is connected between the connection component and the protrusion component, and the protrusion component is adapted to drive the connection component to move via the driven component.

In an embodiment of the invention, two ends of the driven component are pivoted to the connection component and the protrusion component respectively.

In an embodiment of the invention, the connection component includes a base, a movable portion, a second elastic component and a connecting portion, the connecting portion is disposed on the movable portion and adapted to be plugged into the connection interface, and the second elastic component is connected between the base and the movable portion.

In an embodiment of the invention, a material of the protrusion component comprises an elastic material.

In an embodiment of the invention, the connection component is fixed at the main body.

In an embodiment of the invention, the connector module includes at least one elastic portion, wherein the elastic portion is connected between the protrusion component and the main body, and the protrusion component is adapted to move along the first direction due to an elastic deformation of the elastic portion.

In an embodiment of the invention, the elastic portion has an inclined section, and an inclined angle of the inclined section relative to the first direction is 45 degrees.

In an embodiment of the invention, the number of the at least one protrusion component is a plurality, the number of the at least one elastic portion is a plurality, and the protrusion components are respectively connected with the elastic portions and surround the connection component.

In an embodiment of the invention, the protrusion components and the elastic portions are connected integrally.

In an embodiment of the invention, the number of the at least one protrusion component is a plurality, and the protrusion components surround the connection component.

In an embodiment of the invention, the connector module further includes a cushion structure, wherein the connection component comprises a connecting portion, the connecting portion is adapted to be plugged into the connection interface, and the cushion structure is disposed at the connection component to surround the connecting portion.

In an embodiment of the invention, the cushion structure includes a plurality of protruding portions and a plurality of elastic portions, the elastic portions are connected between the protruding portions and the connection component, each of the elastic portions has an inclined section, and an inclined angle of the inclined section relative to the first direction is 45 degrees.

In an embodiment of the invention, the second elastic component includes at least one protruding portion and at least one elastic portion, the protruding portion is in contact with the movable portion, the elastic portion is connected between the protruding portion and the base, the elastic portion has an inclined section, and an inclined angle of the inclined section relative to the first direction is 45 degrees.

In view of the above, in the connector module of the invention, the main body is configured with the protrusion component adjacent to the connection component, and when the connector module is installed within the electronic device, the protrusion component may protrude out of the electronic device. As such, in case that the connector module is not plugged into the corresponding connection interface, the protrusion component or an outer casing of the electronic device can be used to protect the connecting portion of the connection component, so as to prevent the connecting portion from being subjected to abrasion or damaged by the external force. When a user intends to plug the connector module into the corresponding connection interface, the user only requires to move the connection interface towards the connecting portion of the connection component, then the connection interface would push against the protrusion component to enable the connecting portion to be plugged into the connection interface, thereby enabling the connector module to have an intuitive and convenient plug connection operation.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
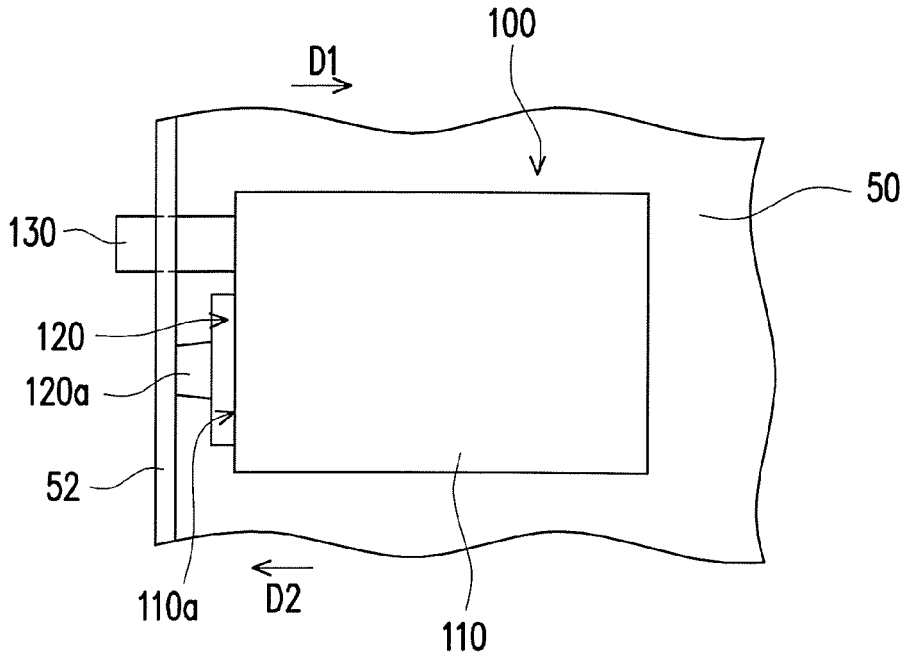
FIG. 1 illustrates a side view of a connector module according to an embodiment of the invention.

FIG. 1 illustrates a side view of a connector module 100 according to an embodiment of the invention. Referring to FIG. 1, the connector module 100 of the present embodiment is, for example, installed on an electronic device 50 and includes a main body 110, a connection component 120 and at least one protrusion component 130 (illustrated as one), wherein the connection component 120 and the protrusion component 130 are located at a same side of the main body 110. The main body 110 has an end surface 110*a*. The connection component 120 is disposed at the main body 110 and protrudes out of the end surface 110*a* of the main body 110. The connection component 120 is located within an outer casing 52 of the electronic device 50 and has a connecting portion 120*a*. The protrusion component 130 is disposed at the main body 110 and protrudes out of the end surface 110*a*, and the protrusion component 130 is protruded out of the outer casing 52 of the electronic device 50. In the present embodiment, the electronic device 50 may be a portable device such as a Tablet PC, a Notebook computer or a Smart Phone, may be a signal/power transmission device such as a transmission line connector or a vehicle charging dock, or may be other type of electronic device, but the invention is not limited thereto.

Figure 2:
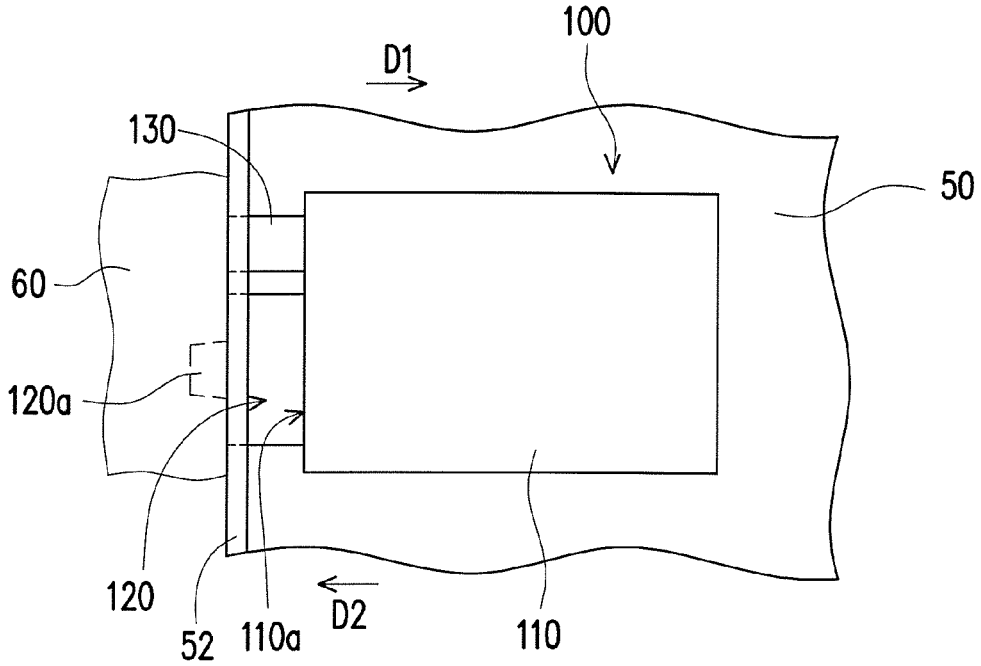
FIG. 2 illustrates the connector module of FIG. 1 being connected to a corresponding connection interface.

FIG. 2 illustrates the connector module of FIG. 1 being connected to a corresponding connection interface. Referring to FIG. 2, the connector module 100 of the present embodiment is adapted to be connected to a connection interface 60, wherein the connection interface 60 may be a connector for a portable device such as a Tablet PC, a Notebook computer or a Smart Phone, may be a connector for a signal/power transmission device such as a transmission line connector or a vehicle charging dock, or may be a connector for other type of electronic device, but the invention is not limited thereto. During a process of plug connection, when the connection interface 60 moves towards the connecting portion 120*a* of the connection component 120, the connection interface 60 pushes the protrusion component 130 along the first direction D1 to provide an external force to drive the connection component 120 and the protrusion component 130 to produce relative movements, as shown in FIG. 1 to FIG. 2, so as to change relative positions of the connection component 120 and the protrusion component 130, so that the connecting portion 120*a* exceeds the protrusion component 130 along a second direction D2 opposite to the first direction D1 and protrudes out of the outer casing 52 of the electronic device 50 to be plugged into the connection interface 60.

With the aforesaid configurations and actuation approaches, in case that the connector module 100 is not plugged into the corresponding connection interface 60, the outer casing 52 of the electronic device 50 may be used to protect the connecting portion 120*a* of the connection component 120, so as to prevent the connecting portion 120*a* from being subjected to abrasion or damaged by the external force. When a user intends to plug the connector module 100 into the corresponding connection interface 60, the user only requires to move the connection interface 60 towards the connecting portion 120*a* of the connection component 120, then the connection interface 60 would push against the protrusion component 130 to enable the connecting portion 120*a* to exceed the protrusion component 130 and be plugged into the connection interface 60, thereby enabling the connector module 100 to have an intuitive and convenient plug connection operation.

In the present embodiment, the protrusion component 130 is slidingly disposed at the main body 110 along the first direction D1, and the connection component 120 is slidingly disposed at the main body 110 along the second direction D2. When the connection interface 60 provides the external force to push the protrusion component 130 to move, the protrusion component 130 moves from the first position shown in FIG. 1 to the second position shown in FIG. 2 along the first direction D1, so as to drive the connection component 120 to move from a position shown in FIG. 2 to a position shown in FIG. 1 along the second direction D2.

Based on the above, a length of the protrusion component 130 protruding from the main body 110 when the protrusion component 130 is at the first position, as shown in FIG. 1, is not less than a length of the connection component 120 protruding from the main body 110; at this moment, the connection component 120 has a smaller protruding length and is suitable to be protected. Whereas, a length of the protrusion component 130 protruding from the main body 110 when the protrusion component is at the second position, as shown in FIG. 2, is less than the length of the connection component 120 protruding from the main body 110; at this moment, the connection component 120 has a greater protruding length and is suitable for being plugged into the connection interface 60.

Figure 3:
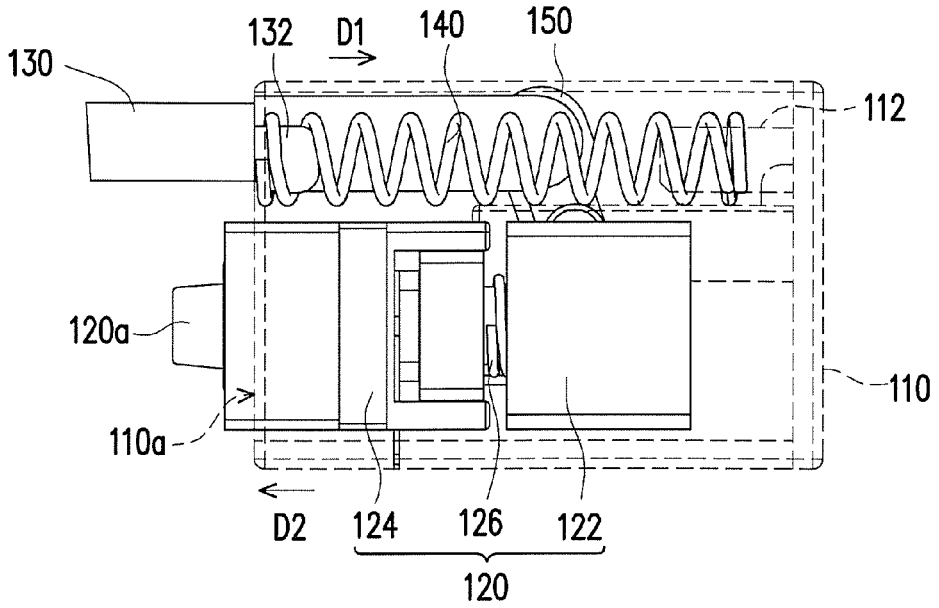
FIG. 3 illustrates the internal structure of the connector module of FIG. 1.
Figure 4:
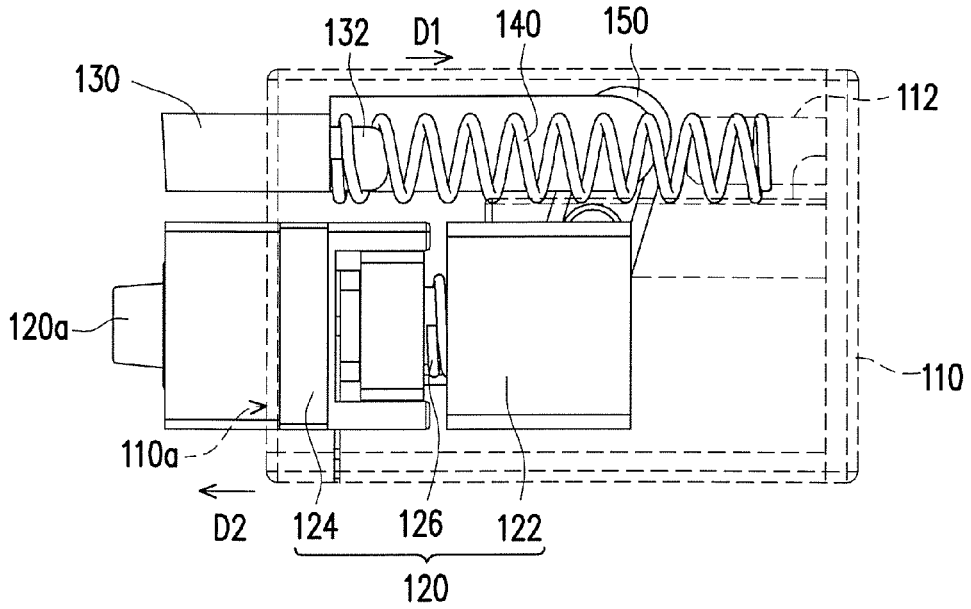
FIG. 4 illustrates the internal structure of the connector module of FIG. 2.

FIG. 3 illustrates the internal structure of the connector module of FIG. 1. FIG. 4 illustrates the internal structure of the connector module of FIG. 2. In order to for clarity of the drawings, the main body 110 is illustrated in perspective views in FIG. 3 and FIG. 4. Referring to FIG. 3 and FIG. 4, more specifically, the connector module 100 includes a first elastic component 140, and the first elastic component 140 is connected between the protrusion component 130 and the main body 110. When the connection interface 60, as shown in FIG. 2, pushes against the protrusion component 130, the protrusion component 130 partially moves towards and into the main body 110, as shown in FIG. 3 to FIG. 4, and thereby drives the connection component 120 to be plugged into the connection interface 60. Under the condition that the connection component 120 is plugged into the connection interface 60, the connection interface 60 keeps to push against the protrusion component 130 to limit the protrusion component 130 at the position shown in FIG. 4. Next, when the user removes the connection interface 60 shown in FIG. 2, the protrusion component 130 is automatically being restored to the position shown in FIG. 3 along the second direction D2 via the elastic force of the first elastic component 140.

In the present embodiment, the protrusion component 130 has a convex pillar 132, the main body 110 has another convex pillar 112 therein, and the first elastic component 140 is, for example, a compression spring and the two ends therefore are respectively inserted with the convex pillar 132 and the convex pillar 112. In other embodiment, the first elastic component 140 may be other type of elastic structure, and may be connected between the protrusion component 130 and the main body 110 by other suitable approach, but the invention is not limited thereto.

Referring to FIG. 3 and FIG. 4, the connector module 100 of the present embodiment includes a driven component 150, and the driven component 150 is connected between the connection component 120 and the protrusion component 130. When the connection interface 60, as shown in FIG. 2, provides the external force to push the protrusion component 130 to move, the protrusion component 130 drives the connection component 120 to move from a position shown in FIG. 3 to a position shown in FIG. 4 via the driven component 150. In the present embodiment, the driven component 150 is, for example, a linking rod and two ends thereof are respectively pivoted to the connection component 120 and the protrusion component 130, but the invention is not limited thereto. In other embodiment, the driven component 150 may be other type of linking component.

Referring to FIG. 3 and FIG. 4, the connection component 120 of the present embodiment further includes a base 122, a movable portion 124 and a second elastic component 126. The connecting portion 120*a* is disposed on the movable portion 124, and the second elastic component 126 is, for example, a compression spring or other type of elastic member that is connected between the base 122 and the movable portion 124. With this configuration, in case that the connector module 100 is plugged into the connection interface 60 shown in FIG. 2, the movable portion 124 may produce a slight displacement via an elastic deformation ability of the second elastic component 126 so as to absorb tolerances in manufacturing and assembling, thereby preventing the connecting portion 120*a* from being damaged due to excessive insertion force.

Figure 5:
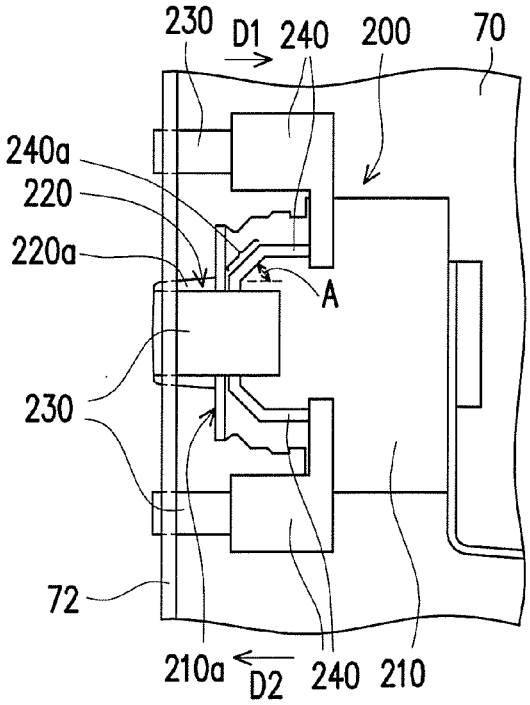
FIG. 5 illustrates a side view of a connector module according to another embodiment of the invention.

FIG. 5 illustrates a side view of a connector module 200 according to another embodiment of the invention. Referring to FIG. 5, the connector module 200 of the present embodiment is, for example, installed at an electronic device 70 and includes a main body 210, a connection component 220 and at least one protrusion component 230 (illustrated as a plurality), wherein the connection component 220 and the protrusion components 230 are located at a same side of the main body 210. The main body 210 has an end surface 210*a*. The connection component 220 is disposed at the main body 210 and has a connecting portion 220*a*. The protrusion components 230 are disposed at the main body 210 and protrude out in relative to the end surface 210*a*, and the protrusion components 230 protrude out of the outer casing 72 of the electronic device 70. In the present embodiment, the electronic device 70 may be a portable device such as a Tablet PC, a Notebook computer or a Smart Phone, may be a transmission line connector, a vehicle charging dock, a power transmission device, or may be other type of electronic device, but the invention is not limited thereto.

Figure 6:
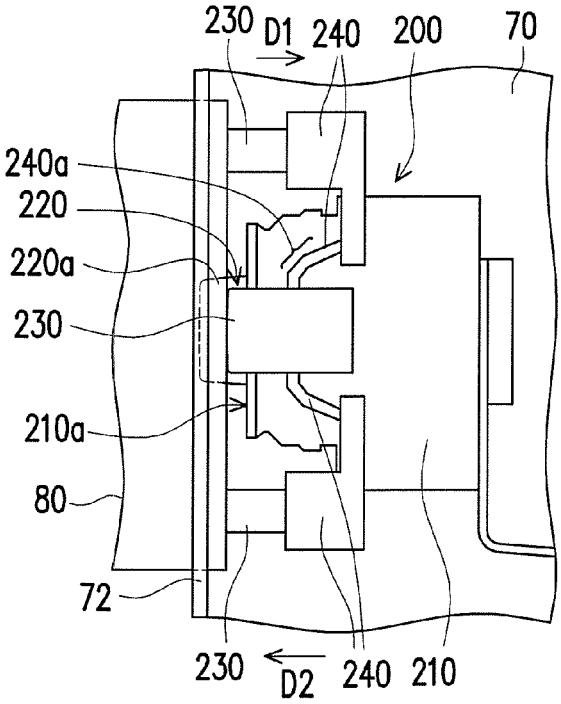
FIG. 6 illustrates the connector module of FIG. 5 being connected to a corresponding connection interface.

FIG. 6 illustrates the connector module of FIG. 5 being connected to a corresponding connection interface. Referring to FIG. 6, the connector module 200 of the present embodiment is adapted to be connected to a connection interface 80, wherein the connection interface 80 may be a connector of a portable device such as a Tablet PC, a Notebook computer or a Smart Phone, may be a connector of a transmission line connector or a vehicle charging dock/power transmission device, or may be a connector of other type of electronic device, but the invention is not limited thereto. During a process of plug connection, when the connection interface 80 moves toward the connecting portion 220*a* of the connection component 220, the connection interface 80 pushes the protrusion components 230 along the first direction D1 to provide an external force for driving the connection component 220 and the protrusion component 230, as shown in FIG. 5 to FIG. 6, to produce relative movements, so as to change relative positions of the connection component 220 and the protrusion components 230, thereby enabling the connecting portion 220*a* to be plugged into the connection interface 80.

With the aforesaid configurations and actuation approaches, in case that the connector module 200 is not plugged into the corresponding connection interface connection interface 80, the protrusion components 230 may be used to protect the connecting portion 220*a* of the connection component 220, so as to prevent the connecting portion 220*a* from being subjected to abrasion or damaged by the external force. When a user intends to plug the connector module 200 into the corresponding connection interface 80, the user only requires to move the connection interface 80 towards the connecting portion 220*a* of the connection component 220, then the connection interface 80 would push against the protrusion components 230 to enable the connecting portion 220*a* to be plugged into the connection interface 80, thereby enabling the connector module 200 to have an intuitive and convenient plug connection operation.

In the present embodiment, the connection component 220 is fixed at the main body 210. The connector module 200 further includes at least one elastic portion 240 (illustrated as a plurality), and the elastic portions 240 are connected between the protrusion components 230 and the main body 210. When the connection interface 80 provides the external force to push the protrusion components 230 to move, each of the protrusion components 230 is adapted to move from a first position shown in FIG. 5 towards the main body 210 and along a first direction D1 relative to the connection component 220 to a second position shown in FIG. 6 via an elastic deformation of the corresponding elastic portion 240. In case that the connection component 220 is plugged into the connection interface 80, the connection interface 80 keeps to push against the protrusion component 230 to limit the protrusion components 230 at positions shown in FIG. 6. Next, when the user removes the connection interface 80, the protrusion components 230 are being automatically restored to the positions shown in FIG. 5 along the second direction D2 via the elastic force of the elastic portions 240.

Based on the above, a length of the protrusion components 230 protruding from the main body 210 when the protrusion components 230 is at the first position, as shown in FIG. 5, is not less than a length of the connection components 220 protruding from the main body 210; at this moment, the connection component 220 has a smaller protruding length in relative to the protrusion components 230 and is suitable to be protected. A length of the protrusion components 230 protruding from the main body 210 when the protrusion components 230 is at the second position, as shown in FIG. 6, is less than a length of the connection components 220 protruding from the main body 210; at this moment, the connection component 220 has a greater protruding length in relative to the protrusion components 230 and is suitable to be plugged into the connection interface 80.

In the present embodiment, each of the elastic portions 240 has an inclined section 240*a* for providing elastic deformation ability. An inclined angle A of each inclined section 240*a* relative to a moving direction (i.e., the first direction D1) of the protrusion component 230 may be 45 degrees, so that that the elastic portion 240 may have favorable elastic deformation ability. In other embodiment, the inclined angle A may be changed to include other appropriate degrees based on design requirements, and the invention is not limited thereto.

Figure 7:
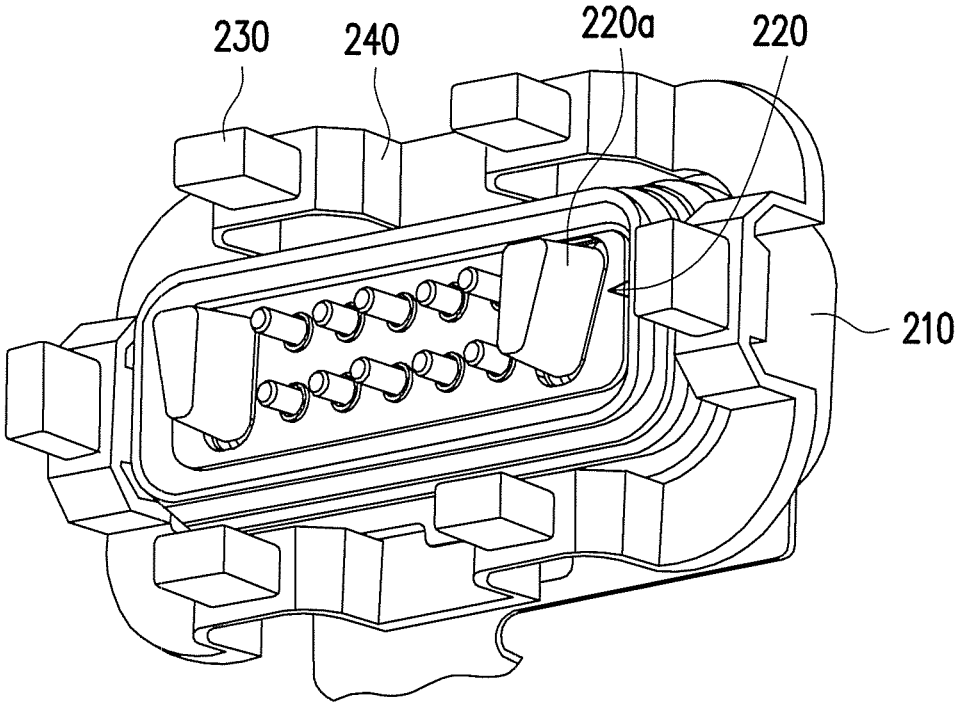
FIG. 7 is a perspective view of the connector module of FIG. 5.

FIG. 7 is a perspective view of the connector module of FIG. 5. Referring to FIG. 7, the protrusion components 230 and the elastic portions 240 of the present embodiment are connected integrally, and the protrusion components 230 surround the connecting portion 220*a* of the connection component 220 so as to effectively protect the connecting portion 220*a*. In addition, a material of the protrusion components 230 and the elastic portions 240 is, for example, rubber or other suitable elastic material with an elastic deformation ability, so as to absorb tolerances in manufacturing and assembling when the connection interface 80 is plugged into the connector module 200, thereby preventing the connecting portion 220*a* from being damaged due to excessive insertion force.

Figure 8:
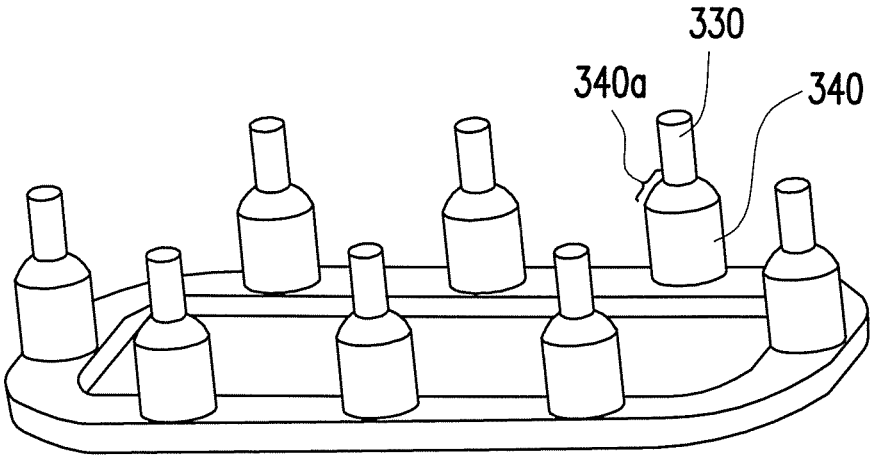
FIG. 8 illustrates a perspective view of a protrusion component and an elastic portion according to another embodiment of the invention.
Figure 9:
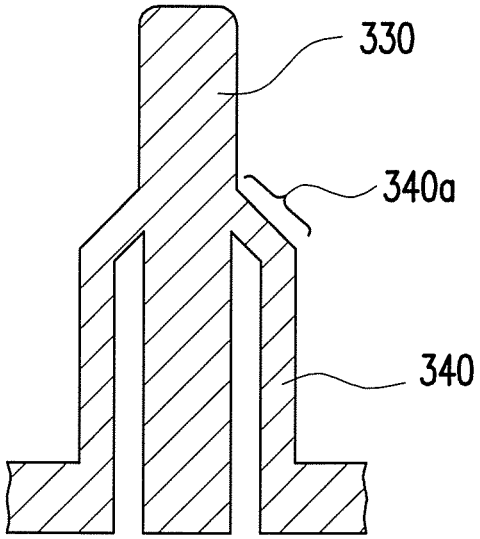
FIG. 9 is a partial sectional view of the protrusion component and the elastic portion of FIG. 8.

In the embodiment shown in FIG. 5 and FIG. 6, each of the elastic portions 240 is in a form of an elastic arm, and each of the protrusion components 230 is a rectangular body and is corresponded to two elastic portions 240, wherein these two elastic portions 240 are respectively connected to two opposite sides of the protrusion component 230. However, the invention does not intend to limit the shapes and forms of the protrusion components and the elastic portions; examples will be described below with drawings. FIG. 8 illustrates a perspective view of a protrusion component and an elastic portion according to another embodiment of the invention. FIG. 9 is a partial sectional view of the protrusion component and the elastic portion of FIG. 8. Referring to FIG. 8 and FIG. 9, each of the protrusion components 330 of the present embodiment is a cylinder, and each of the elastic portions 340 and an inclined section 340*a* thereof appear to be tubular in shape and are connected with the circumferential edge of the corresponding protrusion component 330.

Figure 10:
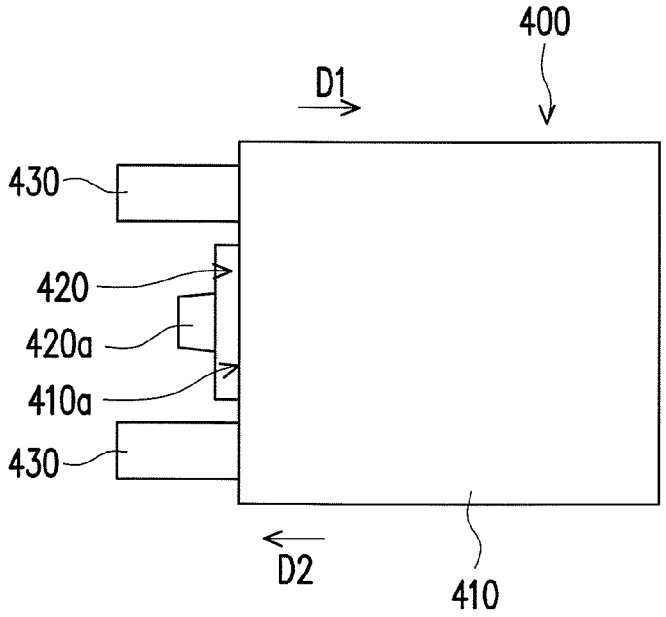
FIG. 10 illustrates a side view of a connector module according to another embodiment of the invention.

FIG. 10 illustrates a side view of a connector module 400 according to another embodiment of the invention. In the connector module 400 of FIG. 10, configurations and actuation approaches of a main body 410, an end surface 410*a*, a connection component 420, a connecting portion 420*a*, and protrusion components 430 are similar to that of the main body 110, the end surface 110*a*, the connection component 120, the connecting portion 120*a*, and the protrusion component 130 in FIG. 1, and thus will not be repeated. Differences between the connector module 300 and the connector module 100 lie in that, the number of the protrusion component 430 is a plurality, and the protrusion components 430 surround the connection component 420. For the clarity of the drawing, only two protrusion components 430 are being illustrated in FIG. 10, but practically, the number of the protrusion components 430 may be four or other appropriate number for distribution around the connection component 420; the invention is not limited thereto. The protrusion components 430 may be connected with each other as one to constitute a circular structure surrounding the connection component 420, or may be separated from each other and not being a circular structure, but the invention is not limited thereto. In addition, the invention does not intend to limit a material of each of the protrusion components 430, such that the material may be an elastic material with cushion effect, or may also be a non-elastic material.

Figure 11:
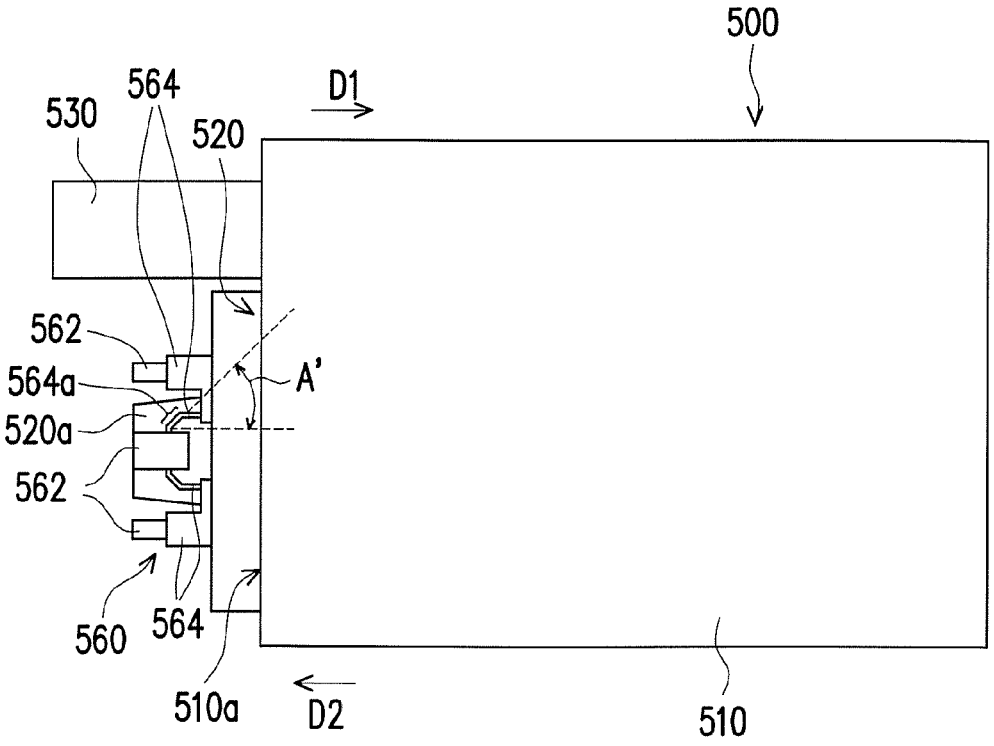
FIG. 11 illustrates a side view of a connector module according to another embodiment of the invention.

FIG. 11 illustrates a side view of a connector module 11 according to another embodiment of the invention. In the connector module 500 of FIG. 11, configurations and actuation approaches of a main body 510, an end surface 510*a*, a connection component 520, a connecting portion 520*a*, and a protrusion component 530 are similar to that of the main body 110, the end surface 110*a*, the connection component 120, the connecting portion 120*a*, and the protrusion component 130 in FIG. 1, and thus will not be repeated. Differences between the connector module 500 and the connector module 100 lie in that: the connector module 500 further includes a cushion structure 560, and the cushion structure 560 is disposed at the connection component 520 and surrounds the connecting portion 520*a*, so as to provide an effect of absorbing tolerances in manufacturing and assembling when the connecting portion 520*a* is plugged into other device. Specifically, a material of the cushion structure 560 may be an elastic material such as rubber or so forth, and the cushion structure 560 may include a plurality of protruding portions 562 and a plurality of elastic portions 564 that are integrally formed. The elastic portions 564 are connected between the protruding portions 562 and the connection component 520. Each of the elastic portions 564 has an inclined section 564*a*, and an inclined angle A' of the inclined section 564*a* relative to the first direction D1 may be 45 degrees, so that the elastic portion 564 can have favorable elastic deformation ability. In other embodiment, the inclined angle A' may be changed to include other appropriate degrees based on design requirements, and the invention is not limited thereto.

Figure 12:
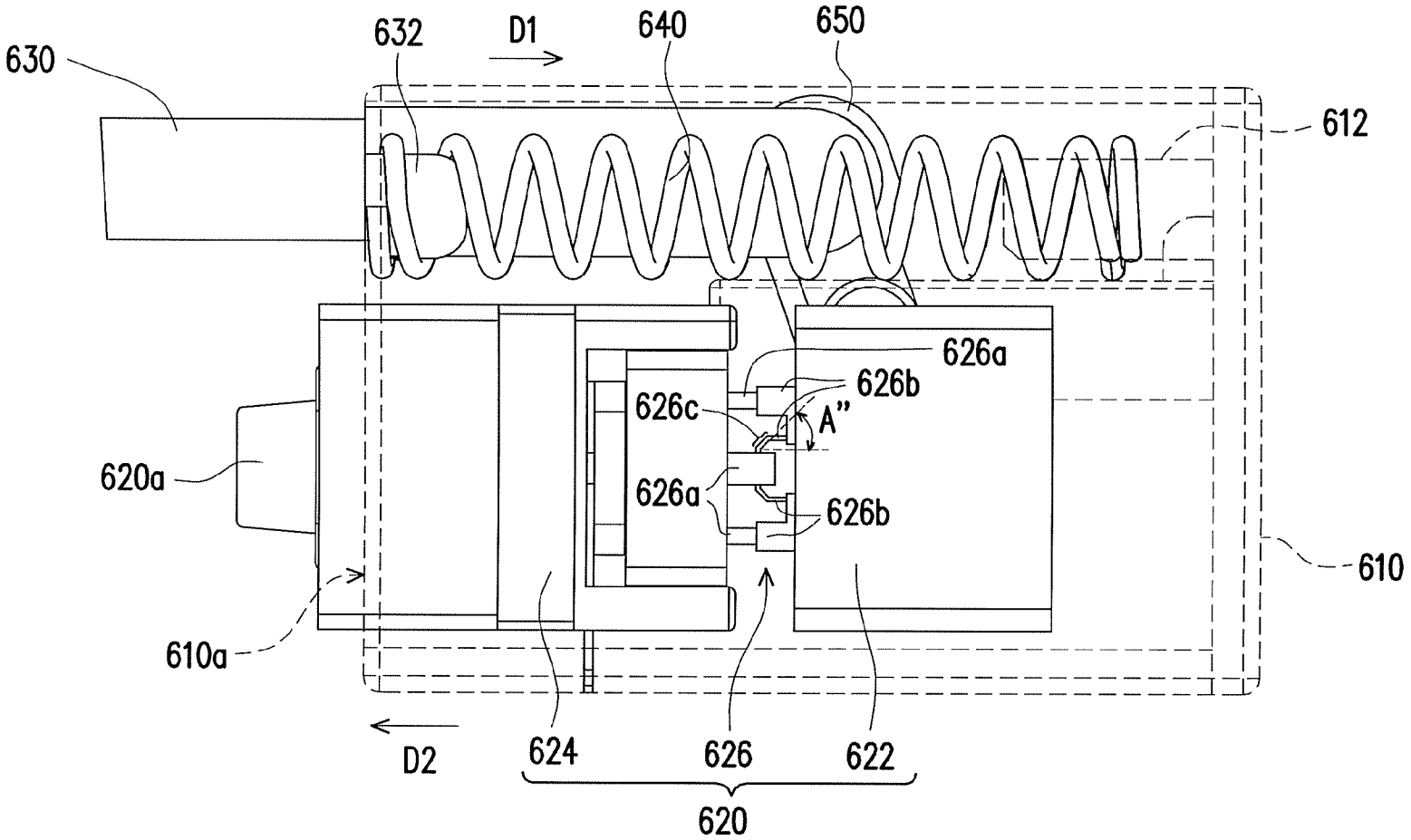
FIG. 12 illustrates the internal structure of a connector module according to another embodiment of the invention.

FIG. 12 illustrates the internal structure of a connector module 600 according to another embodiment of the invention. In the connector module 600 of FIG. 12, configurations and actuation approaches of a main body 610, an end surface 610*a*, a convex pillar 612, a connection component 620, a connecting portion 620*a*, a base 622, a movable portion 624, a second elastic component 626, a protrusion component 630, a convex pillar 632, a first elastic component 640, and a driven component 650 are similar to that of the main body 110, the end surface 110*a*, the convex pillar 112, the connection component 120, the connecting portion 120*a*, the base 122, the movable portion 124, the second elastic component 126, the protrusion component 130, the convex pillar 132, the first elastic component 140, and the driven component 150 in FIG. 3, and thus will not be repeated. Differences between the connector module 600 and the connector module 100 lies in that: the second elastic component 626 is not in a form of spring such as the second elastic component 126 shown in FIG. 3, and the second elastic component 626 is a rubber component including a plurality of protruding portions 626*a* and a plurality of elastic portions 626*b* that are integrally formed. The protruding portions 626*a* are in contact with the movable portion 624, the elastic portions 626*b* are connected between the protruding portions 626*a* and the base 622. Each of the elastic portions 626*b* has an inclined section 626*c*, and an inclined angle A" of the inclined section 626*c* relative to the first direction D1 may be 45 degrees, so that the elastic portion 626*b* may have favorable elastic deformation ability. In other embodiment, the inclined angle A" may be changed to include other appropriate degrees based on design requirements, and the invention is not limited thereto.

In summary, in the connector module of the invention, the main body is configured with the protrusion component adjacent to the connection component, and when the connector module is installed within the electronic device, the protrusion component may protrude out of the electronic device. As such, in case that the connector module is not plugged into the corresponding connection interface, the protrusion component or the outer casing of the electronic device can be used to protect the connecting portion of the connection component, so as to prevent the connecting portion from being subjected to abrasion or damaged by the external force. When the user intends to plug the connector module into the corresponding connection interface, the user only requires to move the connection interface towards the connecting portion of the connection component, then the connection interface would push against the protrusion component to enable the connecting portion to be plugged into the connection interface, thereby enabling the connector module to have an intuitive and convenient plug connection operation. In addition, the connector module can be disposed with an elastic structure (i.e., the aforementioned second elastic component or the elastic portion) therein, so as to absorb the tolerance in manufacturing and assembling via the elastic structure when the connector module is plugged into the corresponding connection interface, and thereby prevent the connecting portion from being damaged due to excessive insertion force.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector module, adapted to be connected to a connection interface, the connector module comprising:

a main body;

a connection component, disposed at the main body; and at least one protrusion component, disposed at the main body, wherein the protrusion component is adapted to receive an external force to move along a first direction, so as to change relative positions of the connection component and the protrusion component so that the connection component is adapted to be plugged into the connection interface along a second direction, and the first direction is opposite to the second direction.

2. The connector module as recited in claim 1, wherein the connection interface is adapted to push the protrusion component along the first direction so as to provide the external force.

3. The connector module as recited in claim 1, wherein the protrusion component is adapted to move from a first position to a second position along the first direction, a length of the protrusion component protruding from the main body when the protrusion component is at the first position is not less than a length of the connection component protruding from the main body, a length of the protrusion component protruding from the main body when the protrusion component is at the second position is less than a length of the connection component protruding from the main body.

4. The connector module as recited in claim 1, wherein the protrusion component is slidingly disposed at the main body along the first direction, and the connection component is slidingly disposed at the main body along the second direction.

5. The connector module as recited in claim 1, comprising a first elastic component, wherein the first elastic component is connected between the protrusion component and the main body, and after the protrusion component moves along the first direction, the protrusion component is adapted to be restored along the second direction via an elastic force of the first elastic component.

6. The connector module as recited in claim 1, wherein the connector module is adapted to be installed at an electronic device, the protrusion component protrudes out of the electronic device, the connection component is located within the electronic device, the protrusion component is adapted to move along the first direction to drive the connection component to protrude out of the electronic device along the second direction.

7. The connector module as recited in claim 1, comprising a driven component, wherein the driven component is connected between the connection component and the protrusion component, and the protrusion component is adapted to drive the connection component to move via the driven component.

8. The connector module as recited in claim 7, wherein two ends of the driven component are pivoted to the connection component and the protrusion component respectively.

9. The connector module as recited in claim 1, wherein the connection component comprises a base, a movable portion, a second elastic component and a connecting portion, the connecting portion is disposed on the movable portion and adapted to be plugged into the connection interface, and the second elastic component is connected between the base and the movable portion.

10. The connector module as recited in claim 1, wherein a material of the protrusion component comprises an elastic material.

11. The connector module as recited in claim 1, wherein the connection component is fixed at the main body.

12. The connector module as recited in claim 1, comprising at least one elastic portion, wherein the elastic portion is connected between the protrusion component and the main body, and the protrusion component is adapted to move along the first direction due to an elastic deformation of the elastic portion.

13. The connector module as recited in claim 12, wherein the elastic portion has an inclined section, and an inclined angle of the inclined section relative to the first direction is 45 degrees.

14. The connector module as recited in claim 12, wherein the number of the at least one protrusion component is a plurality, the number of the at least one elastic portion is a plurality, and the protrusion components are respectively connected with the elastic portions and surround the connection component.

15. The connector module as recited in claim 12, wherein the protrusion components and the elastic portions are connected integrally.

16. The connector module as recited in claim 1, wherein the number of the at least one protrusion component is a plurality, and the protrusion components surround the connection component.

17. The connector module as recited in claim 1, further comprising a cushion structure, wherein the connection component comprises a connecting portion, the connecting portion is adapted to be plugged into the connection interface, and the cushion structure is disposed at the connection component to surround the connecting portion.

18. The connector module as recited in claim 17, wherein the cushion structure comprises a plurality of protruding portions and a plurality of elastic portions, the elastic portions are connected between the protruding portions and the connection component, each of the elastic portion has an inclined section, and an inclined angle of the inclined section relative to the first direction is 45 degrees.

19. The connector module as recited in claim 9, wherein the second elastic component comprises at least one protruding portion and at least one elastic portion, the protruding portion is in contact with the movable portion, the elastic portion is connected between the protruding portion and the base, the elastic portion has an inclined section, and an inclined angle of the inclined section relative to the first direction is 45 degrees.

* * * * *